US005662138A

United States Patent [19]

Wang

[11] Patent Number: 5,662,138

[45] Date of Patent: Sep. 2, 1997

[54] DROP HEAD STRUCTURE

[76] Inventor: Wen-Hsing Wang, No. 26, Alley 55, Lane 12, Tzu Chiang 3rd St., Wu Chi Chen, Taichung Hsien, Taiwan

[21] Appl. No.: 661,914

[22] Filed: Jun. 12, 1996

[51] Int. Cl.[6] ..... F16K 31/22; E03F 7/04

[52] U.S. Cl. ..... 137/433; 4/287; 4/682; 4/688; 137/315; 137/449; 137/519.5; 137/533.13; 137/533.15

[58] Field of Search ..... 4/286, 287, 295, 4/682, 688; 137/218, 315, 433, 449, 454.2, 511, 533.13, 533.15, 519.5

[56] References Cited

U.S. PATENT DOCUMENTS

| | | | |
|---|---|---|---|
| 160,800 | 3/1875 | Walker | 137/433 |
| 576,790 | 2/1897 | O'Brien | 137/433 |
| 592,690 | 10/1897 | Bragger | 137/433 |
| 592,814 | 11/1897 | McCann | 137/533.13 |
| 783,493 | 2/1905 | Wood | 137/533.12 |
| 859,540 | 7/1907 | Bonnell | 137/433 |
| 1,046,741 | 12/1912 | Dehn | 137/433 |
| 1,176,785 | 3/1916 | Stielow | 137/433 |
| 1,218,482 | 3/1917 | Schlag | 137/433 |
| 1,366,028 | 1/1921 | Schlag | 137/433 |
| 2,199,673 | 5/1940 | Ronning | 137/433 |
| 2,476,434 | 7/1949 | Spang | 137/433 |
| 2,871,875 | 2/1959 | Dale | 137/433 |
| 3,770,001 | 11/1973 | Davis | 137/533.15 |
| 4,262,692 | 4/1981 | Sampson | 137/433 |
| 5,005,603 | 4/1991 | Amundson et al. | 137/433 |

*Primary Examiner*—George L. Walton
*Attorney, Agent, or Firm*—Bacon & Thomas

[57] ABSTRACT

The present invention relates to a water drop structure which not only functions as a water drop but also prevents pests from intruding indoors, smell from leaking indoors, and sewage back flow when the robe is clogged. It has a main body, main drum, control floating ball, upper partition, and an upper cover. The main body has a positioning flange, main through hole, let-in sheet to form a let-in slot, and a main drum having a lower through hole, union sheet, and upper partition having a spacer with a recess, upper through hole, and its peripheral having union sheet, the upper cover having water drop hole, and the bottom having extension hood with inside diameter smaller than that of upper partition. The main drum and upper partition may be set in the main drum, and an upper cover can be assembled in the upper partition. The control floating ball is located between the main drum and upper partition, and extension hood and upper partition recess to form a flow passage for sewage flow, and with the function of control floating ball it may seal the lower through hole when there is no water drop to prevent entry of pests and smell. The control floating ball shall float up owing to water when the tube is clogged, and therefore seal the upper through hole for preventing water back flow.

2 Claims, 7 Drawing Sheets

DROP HEAD STRUCTURE

BACKGROUND OF THE INVENTION

The present invention relates to a drop head which is functional for water drop, pest control, smell prevention, and back-flow prevention, rather than just a simple function of water drop. It may be dismounted with components for replacement and maintenance.

Most drop heads are a simple plate with holes for the sole purpose of water drop and have the following defects:

1. With the function of water drop only, it is not available for preventing pests intrusion, smell leakage (drop tube may produce smell) and back flow of sewage in the tube when choked up.
2. All are permanent type not easy for replacement and maintenance.
3. Cannot be dismounted for mounting other fitting to meet the need (such as if desiring for the insertion of drain tube of washing machine).

Some have made improvement by mounting pest control device but they have following defects:

1. Cannot prevent smell leakage, or back flow of sewage when the tube is choked up.
2. Also permanent type not easy for replacement and maintenance.
3. Cannot be dismounted for mounting other fitting to meet the need.

SUMMARY OF THE INVENTION

In view of various defects found in the conventional arts, the inventor has successfully developed the present invention for the purpose of solving the following problems:

1. A controllable floating ball permits water to flow during normal water drop, and prevents pests from climbing out and smell leaking when water is not dropped. It prevents back flow of sewage and sludge when the tube is choked up.
2. Assembly is easy for replacement and maintenance.
3. Assembly can be dismounted with control component for direct passing through the hole passage for through drainage by the match of other component.

These and other objects and advantages of the present invention will become apparent to those skilled in art after considering the following detailed specification together with the accompanying drawings.

DETAILED DESCRIPTION OF THE PREFERRED EMBODIMENT

Figure 1:
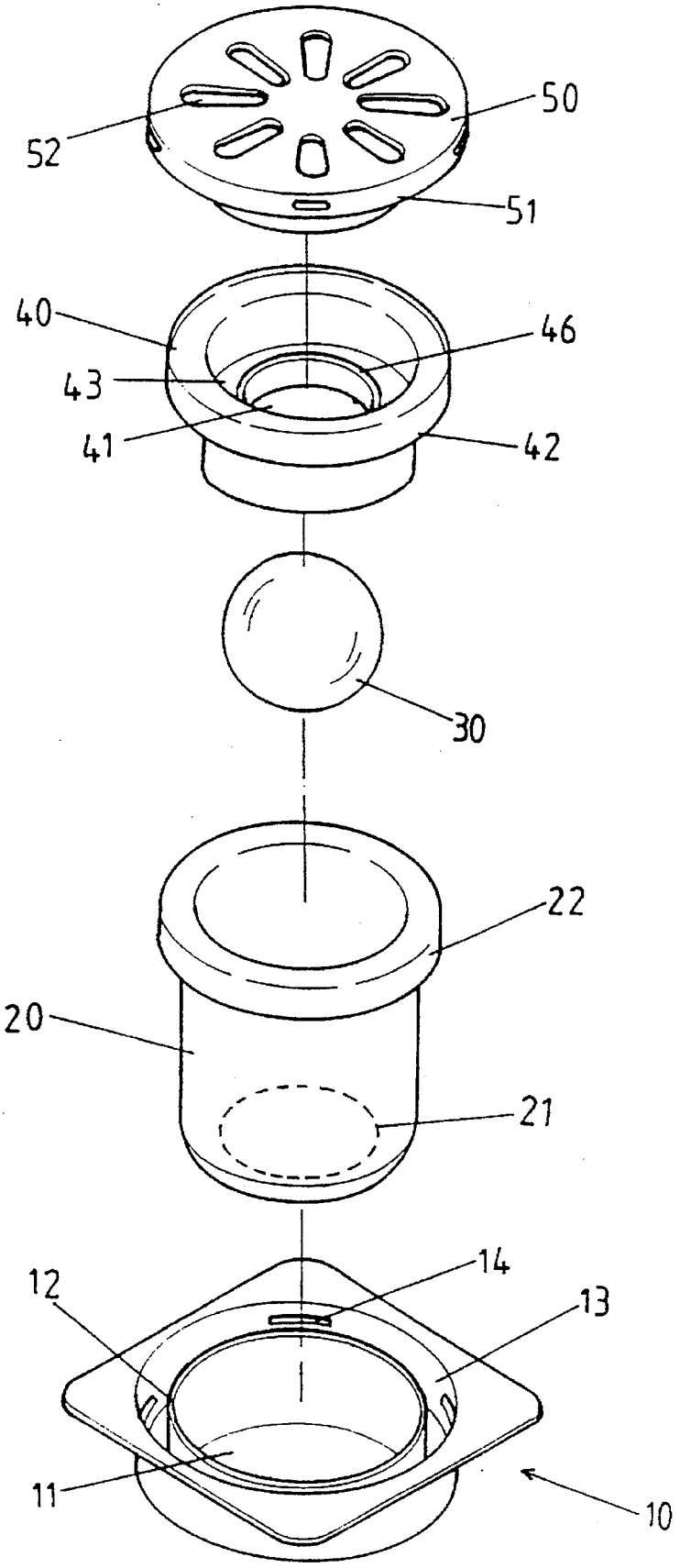
FIG. 1 is an exploded perspective view of the present invention.
Figure 2:
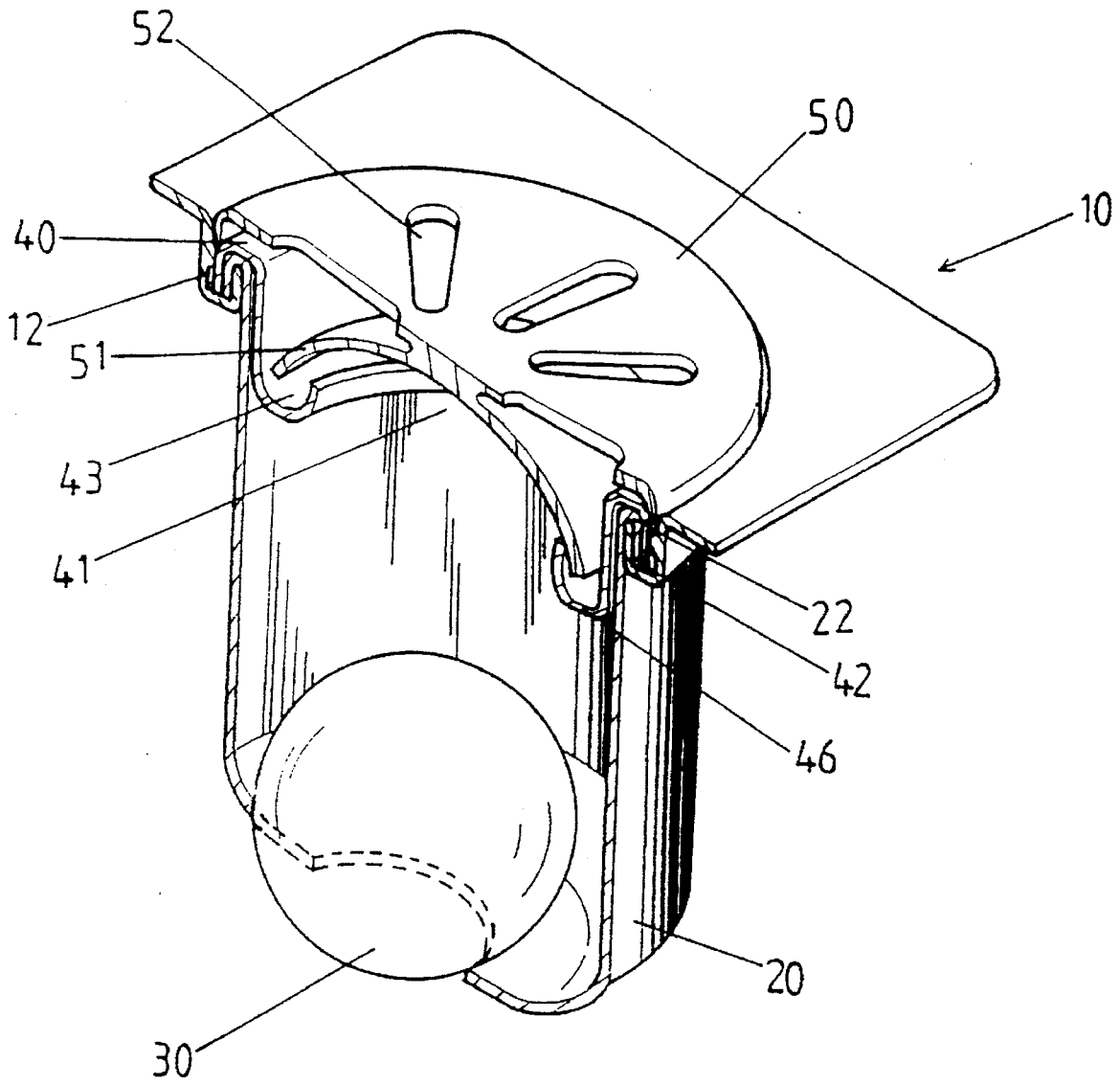
FIG. 2 is a cross-sectional perspective view of the present invention.

Referring to FIGS. 1 and 2, the present invention comprises a main body 10, main drum 20, control floating ball 30, upper partition 40, and upper cover sheet 50.

The center of said main body 10 has a main though hole 11, an inner edge having positioning flange 14 and U let-in sheet or an U-shaped flange to form let-in slot or an opening 13.

Said main drum 20 has lower through hole 21 with smaller bore on the bottom, and periphery of top end has union sheet or an inverted U-shaped flange 22 of which diameter is slightly greater than that of let-in sheet 12.

Said control floating ball 30 is floatable, and has a diameter greater than the lower through hole 21 of main drum 20 and upper through hole 41 of spacer 46 of upper partition 40.

Said upper partition 40 has spacer 46 with a recess 43 on the bottom, and the center also has an upper through hole.

Said upper cover 50 has a plurality of drop holes 52, and has flat-round extension hood 51 on the bottom, having a diameter greater than upper through hole 41 while smaller than the inside diameter of upper partition 40 to form curved flow passageway 45 with the recess 43 of spacer 46.

Figure 3:
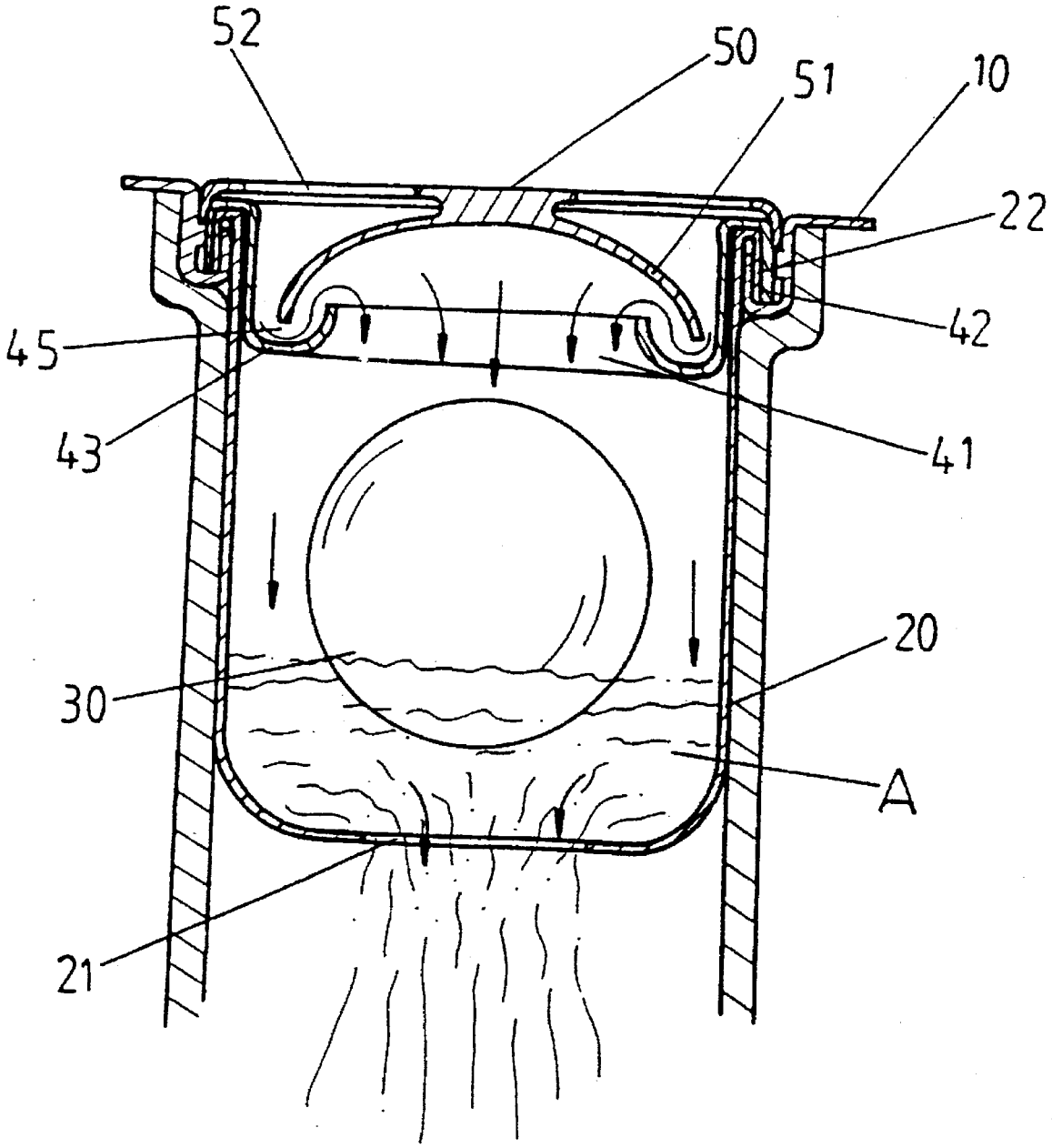
FIG. 3 is a cross-sectional view of water drop of the present invention.

Referring to FIGS. 2 and 3, said main body 10 is fixed to the floor for placing main drum 20 in the main through hole 11 of main body 10, and the spacer 22 may be fitting with the let-in sheet 12 of main body 10. The control floating ball 30 is placed in the main drum 20, upper partition 40 is placed on the top of the main drum 20, and the spacer 42 of upper partition 40 is fitted with the spacer 22 of main drum 20 by the let-in sheet 12 of main body 10 to form integral body of upper partition 40, control floating ball 30, main drum 20, main body 10. Finally upper cover 50 is placed in the upper partition 40 and the connection of upper cover 50 and main body 10 limited by positioning flange 44 to maintain straight with the floor.

Figure 4:
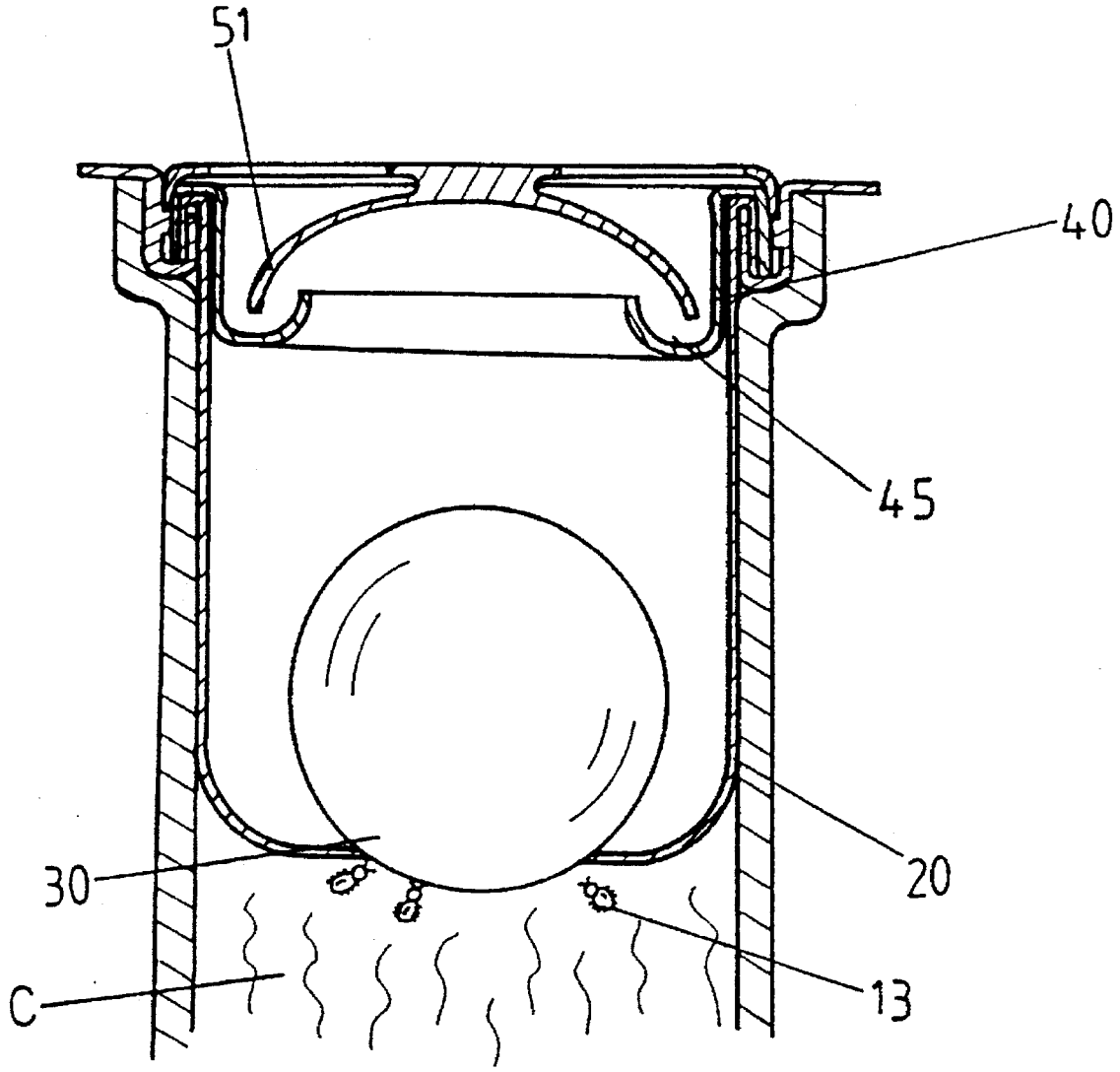
FIG. 4 is a cross-sectional view of the present invention illustrating pest and smell control.
Figure 5:
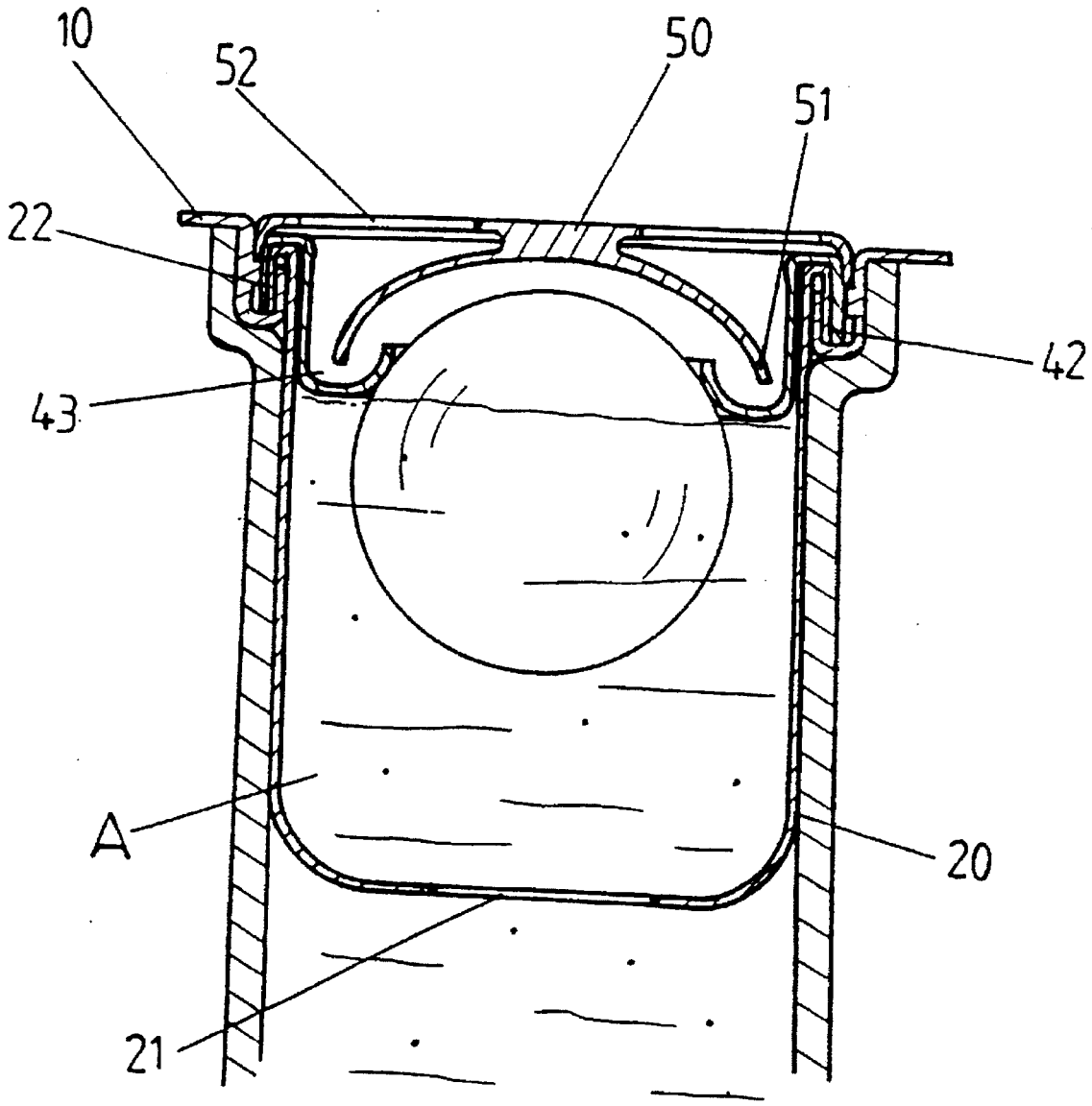
FIG. 5 is a cross-sectional view of the present invention illustrating back flow prevention.

The present invention upon completion of assembly may have following advantages:

1. Normal water drop: (refer to FIG. 3) Water A may enter water drop hole 52 from the upper cover 50, and further enter the main drum 20 from the passage 45 along the extension hood 51, and finally flow out of lower through hole 21. As the floating ball 30 is floatable so it may let water flow out.
2. Pest and smell prevention: (refer to FIG. 4) Without water drop, the floating ball may seal the lower through hole 21 of main drum 20 with the help of its own weight, and certainly smell C will not leak out. Pest 13 will also be prevented by the floating ball 30, even though the force of pest is larger than the weight of the floating ball 30, it means the pest 13 has a very large size (such as cockroach,) and it will be prevented by the extension hood 51 (the gap formed between the extension hood 51 and spacer 46 of upper partition 40 is small and curve) so the pest can not climb out.
3. Prevention of sewage back flow when tube is clogged: (refer to FIG. 5) It is comprehensible that, when the tube is not communicated, water will rise up into the main drum 20 and the control floating ball 30 will go up till sealing the upper through hole 41. The more the water rises the bigger floating force will be produced to cause the control floating ball 30 seal the upper through hole 41 more tightly until no water drop occurs.
4. Easy for maintenance, replacement and match with other components to appear direct-thru drainage:

(1) When the tube or main drum 20, upper partition 40 is clogged, it may be dismounted with the upper cover 50, upper partition 40 and main drum in sequence for the removal of impurity, or for communication with the tube.

(2) If desiring to increase the speed and volume of drainage such as the drainage of a washing machine, the upper cover 50 or upper cover 50 and upper partition 40, or upper cover 50, upper partition 40 and main drum 20 may be dismounted to allow direct insertion of a drainage tube of a washing machine into the main body 10 to gain direct drainage function.

Figure 6:
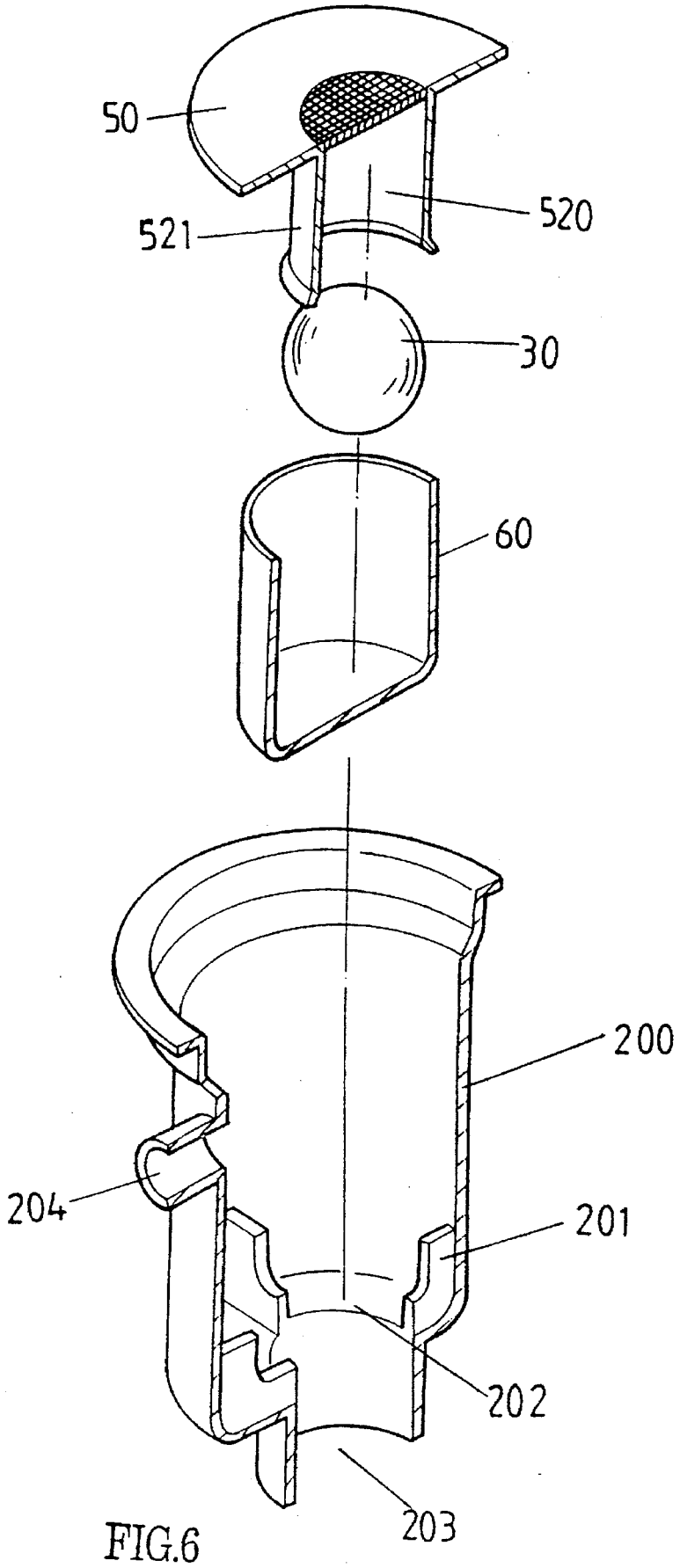
FIG. 6 is an exploded perspective view of another embodiment of the present invention.
Figure 8:
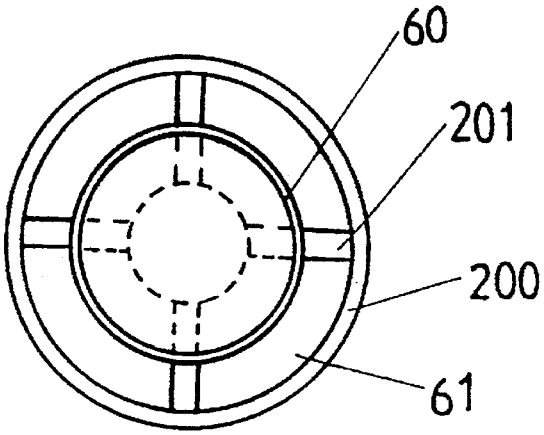
FIG. 8 is a cross-sectional view taken along line I—I in FIG. 7.
Figure 7:
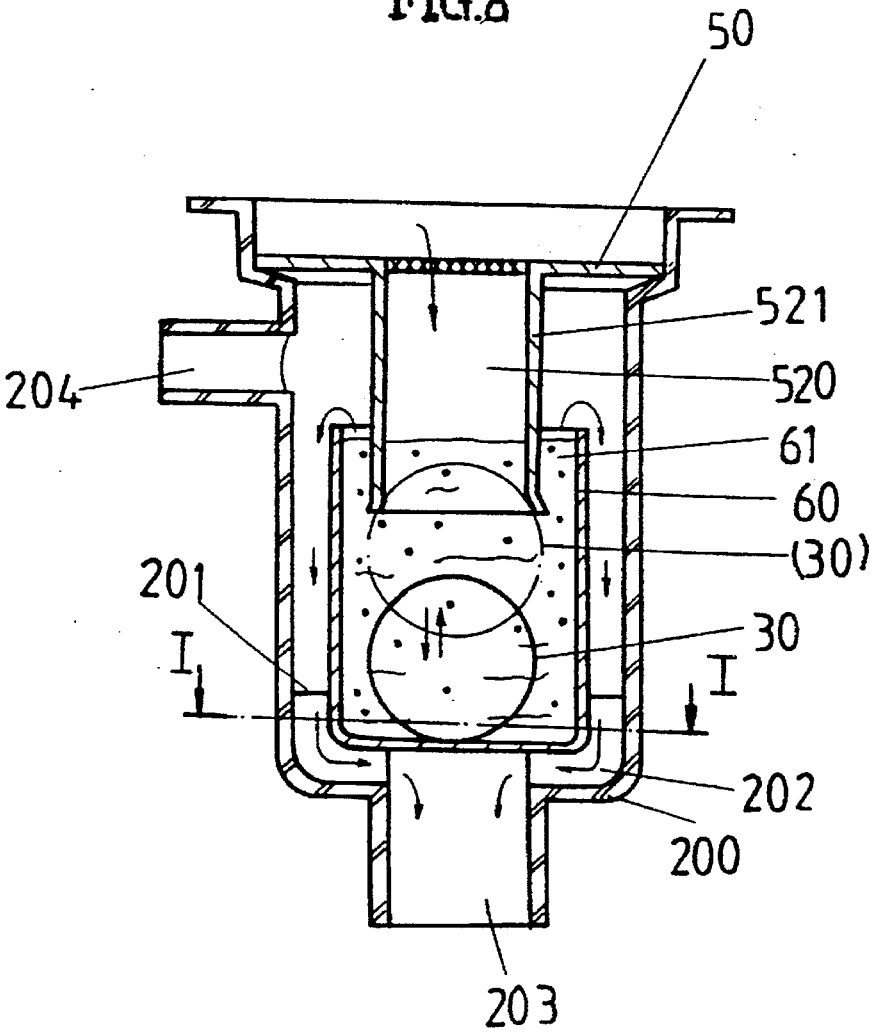
FIG. 7 is a cross-sectional view of the embodiment of FIG. 6.

Another embodiment of the present invention to obtain preferred smell prevention effect is shown in FIGS. 6–8. The upper cover 50 has a longer extension drum 521 on the bottom; the main drum 200 is made with water level Control hole 204 side-wise, inside with a plurality, of seat sheets 201, and each seat sheet has reserved a notch 202 that communicates with the main through hole 203, and a water storage cup 60 on the seat sheet 201. The extension drum 521 of the upper cover 50 is hence located in the water storage cup 60 and there has a gap 61. Control floating ball 30 is located between the water storage cup 60 and extension drum 521 for moving up and down. The actions and advantages of the aforesaid structure are described as below.

Referring to FIG. 7, when water is dropped from the water drop hole 520 of upper cover 50, it shall flush (push down) the control floating ball 30 so water may enter the water storage cup 60 and overflow directly from the gap 61, and drain by flowing into the main through hole 203 from the notch 202 of the main drum 200. On the other hand, if the main through hole 203 has back flow, it may be discharged from the water level control hole 204. When water enters the water storage cup 60, because of floating force of the control floating ball 30, the floating ball 30 shall choke up the water drop hole 520 (floating ball will sink down because there has flush force on the top) to cause back flow not to overflow from the water drop hole 520. Because of separation by the water stored in the water storage cup 60, and certainly it can not be communicated to the water drop hole 520 to prevent the spread of smell.

I claim:

1. A water drop structure comprising:

a main body having a main through hole in a center, a positioning flange located on an inner edge and a U-shaped flange forming as opening;

a main drum extending through the main hole, the main drum having a lower through hole on a bottom, and a peripheral portion of a top end having an inverted U-shaped flange engaging the U-shaped flange;

a floatable control floating ball located in the main drum having a diameter greater than that of the lower through hole of the main drum;

an upper partition having a spacer with a recess, the spacer having a partition spaced from the recess for engaging said U-shaped flange and a center having an upper through hole; and, an upper cover having a plurality of drop holes, extending over the upper partition and having a curved extension hood extending from a bottom thereof, the extension hood having a diameter greater than the upper though hole of the upper partition and smaller than an inside diameter of the upper partition so as to form a curved flow passage with the recess of the spacer wherein the control floating ball blocks the lower through hole of the main drum when no water passes through the structure and the floating ball blocks the upper through hole of the upper partition when fluid flows into the main drum through the lower through hole to prevent a fluid flow back-up due to a clogged condition; from passing through the curved flow passage, wherein the peripheral portion of the drum, a peripheral portion of the positioning flange, the inverted U-shaped flange, the U-shaped flange and an outer portion peripheral portion of the cover cooperates with one another to secure these elements to the inner edge of the main body.

2. A water drop structure comprising:

a) a main drum having a main through hole in a bottom, a water level control hole through a side wall and a plurality of guide seats having a plurality of fluid flow notches communicating with the main through hole;

b) a water storage cap positioned on the guide seats within the main drum and having an open upper end;

c) an upper cover mounted on the main drum having an extension drum extending therefrom, the extension drum having an open end portion extending into the water storage cup so as to form a a water flow gap between the water storage cup and the extension drum; and p1 d) a floatable control floating ball located in the water storage cup so as to block the open end of the extension drum against a water backflow therein when the water level in the water storage cup reaches a predetermined level to prevent the water backflow from passing through the extension drum, thereby allowing the water backflow within the water storage cup to exit through the fluid flow gap and back into the main drum and out the water level control hole, and permitting the water back flow entering from the main through hole into the main drum to be discharged from the main drum through the plurality of water flow notches and out the water level control hole.

* * * * *